United States Patent [19]

Götte

[11] Patent Number: 4,755,136

[45] Date of Patent: Jul. 5, 1988

[54] BURNER FOR GASEOUS FUELS, ESPECIALLY FOR BOILERS

[75] Inventor: Albert Götte, Emmebrücke, Switzerland

[73] Assignee: Ygnis S.A., Switzerland

[21] Appl. No.: 5,159

[22] PCT Filed: Mar. 14, 1986

[86] PCT No.: PCT/CH86/00036

§ 371 Date: Dec. 11, 1986

§ 102(e) Date: Dec. 11, 1986

[87] PCT Pub. No.: WO86/06150

PCT Pub. Date: Oct. 23, 1986

[30] Foreign Application Priority Data

Apr. 11, 1985 [CH] Switzerland ..... 1542/85

[51] Int. Cl.[4] ..... F23D 14/62

[52] U.S. Cl. ..... 431/354; 239/414; 239/416.4; 239/432; 239/562

[58] Field of Search ..... 431/354; 239/401, 412, 239/414, 416, 416.4, 438, 456, 432, 562, 579, 581.1, 581.2; 137/625.4

[56] References Cited

U.S. PATENT DOCUMENTS 1,480,146 1/1924 Bradshaw ..... 239/412
2,377,497 1/1943 Hopkins .
2,863,500 12/1958 Schumann ..... 239/416
3,331,424 7/1967 Heinrich ..... 239/412

FOREIGN PATENT DOCUMENTS 589822 7/1977 Switzerland .
317582 8/1929 United Kingdom .

*Primary Examiner*—Samuel Scott
*Assistant Examiner*—Noah P. Kamen
*Attorney, Agent, or Firm*—Ostrolenk, Faber, Gerb & Soffen

[57] ABSTRACT

The burner for gaseous fuels is especially intended for boilers. It is provided with sliding and/or turning means (15, 37) so as to assure, at least, in the output range of between 50 and 100% of the rated output, an at least approximately constant quantity relationship between gas and combustion air. For this purpose, for the simultaneous change in the admission of gas and air into a mixing chamber (24), there is used a control component, for example, a piston (15, 37). A first moveable, turning and/or sliding control piston (15) is provided the outer cylindrical surface of which controls the amount of combustion air while inside the first, tubular control piston (15) there is a second control piston (37) preferably coaxial to the first control piston (15), which controls the amount of gas by means of its inner cylindrical surface. The two control pistons (15, 37) are firmly attached to one another and can be pushed back and forth and/or turned by means of an actuating device (33).

17 Claims, 1 Drawing Sheet

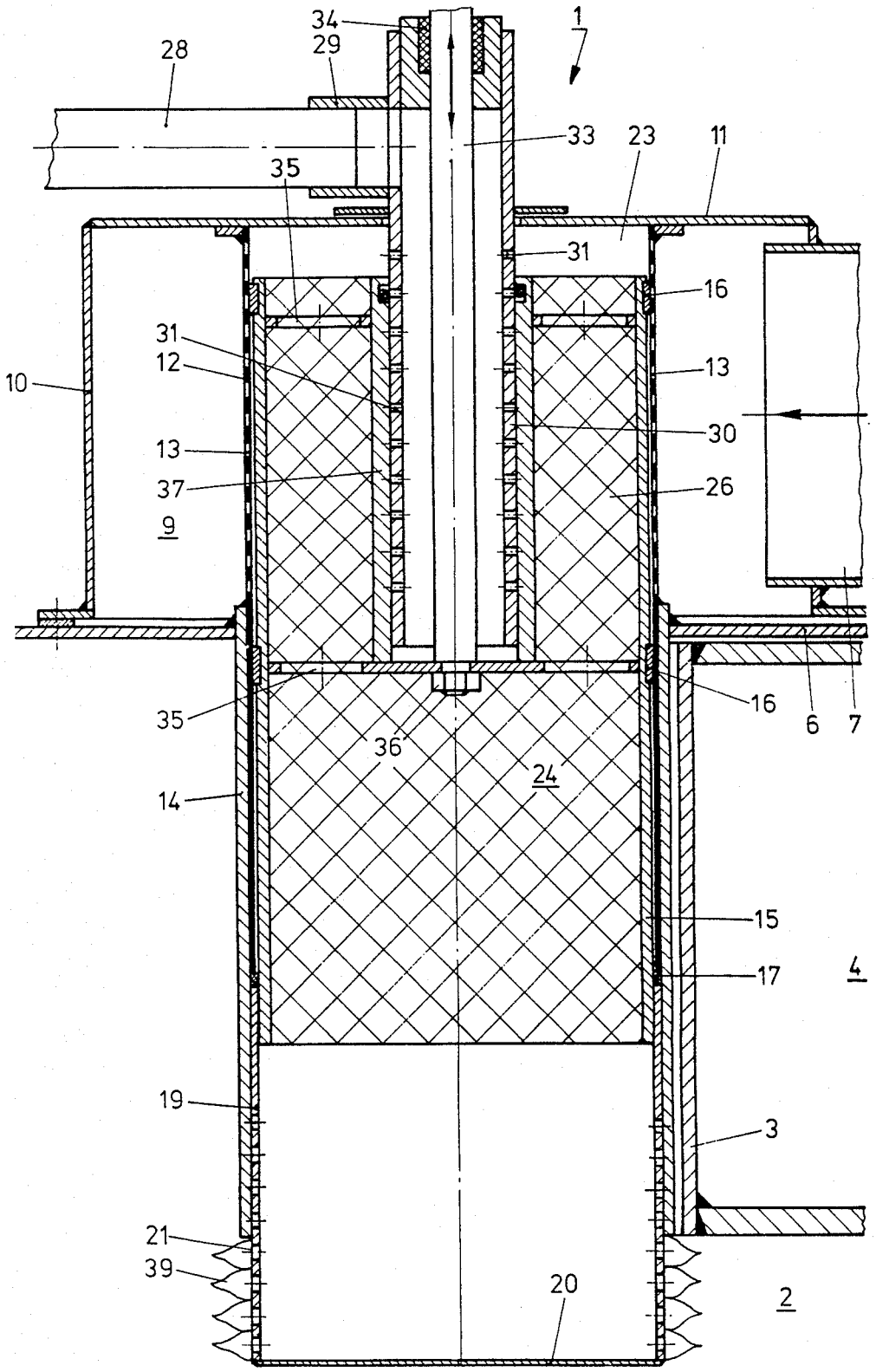
34
29
28
1
33
23
11
35
31
16
31
12
10
13
30
13
37
26
9
35
16
6
7
36
24
14
15
17
4
19
3
21
39
20
2

BURNER FOR GASEOUS FUELS, ESPECIALLY FOR BOILERS

BACKGROUND AND SUMMARY OF THE INVENTION

The present invention concerns a burner for gaseous fuels, particularly for boilers, as well as a process for the burning of gaseous fuels with excess air under changing load in a combustion chamber.

The known burners of this type permit only a regulating in the range of 80 to 100% of the rated output. They therefore make difficult an operation which is as uniform as possible of such burners in the sense of prolonged operating times of a boiler.

The purpose of the present invention is the creation of a burner for gaseous fuels which makes possible regulation within a wide range with optimal operation of the burner, i.e. with an efficiency which is substantially constant over the range of regulation. Such a measure is also in the interest of the protection of the environment.

The burner of the invention, which broadly satisfies these requirements, is distinguished by the fact that sliding and/or turning means are provided in order to assure at least an approximately constant quantitative ratio of gas to combustion air, at least over an output range of 10 to 100% of the rated output.

BRIEF DESCRIPTION OF THE DRAWING

One embodiment of the invention is explained below with reference to a figure which shows a longitudinal section through a burner for gaseous fuels that is installed on a boiler.

DESCRIPTION OF A PREFERRED EMBODIMENT

A gas burner 1 is installed in a boiler 2 having an output of, for instance, up to 300 KW. A boiler wall 3 together with a portion of the water chamber 4 of the boiler 2 can be seen. The gas burner 1 is bolted to the boiler wall 3 by means of a fastening flange 6.

A lateral blower-air feeds connection 7 feed combustion air from the blower (not shown) into an air prechamber 9, which is preferably cylindrical. The latter is limited by a tubular jacket 10 and an outer bottom 11 welded thereon. Inside said jacket is a cylindrically arranged air control plate 12 with lateral openings 13. An immersion tube 14, within which a slide 15 which is also tubular is longitudinally displaceable, also forms part of the burner housing. The immersion tube 14 and slide 15 are mounted for displacement within each other by two guide rings 16, while a suitable sealing ring 17 prevents the rising of air-gas mixture coming from the slide 15. A burner tube 19 is welded on the tubular slide 15, in its extension, the end of which tube is closed by a bottom 20, while lateral flame holes 21 permit the emergence of the combustible gas-air mixture.

Above the slide 15, which is open at its rear, and limited, on the one side, by the outer bottom 11 and, on the other side, by the air control plate 12, there is an entrance chamber 23 within which the combustion air entering through the openings 13 meets the gas which enters through the corresponding exposed openings 31, in order then to flow together into a mixing chamber 24. Perforated plates such as the air control plate 12 are known in fluid dynamics. Here they serve to improve the mixing process, to premix the gas and the air in front of the mixing chamber 24. A static mixer 26 is arranged within the mixing chamber 24. Turbulators, such as are used in flue gas pipes, or similar baffle plates which produce an optimum mixing to a homogeneous gas-air mixture, can be employed. In this connection, care should be taken that the dimensions of the mixer 26 are such that no noticeable backwash effect occurs on the entrance chamber 23 or, in other words, that the entrance cross sections of the openings 13 and 31 in the said control region are alone substantially determining for the ratio of gas to combustion air which is at least approximately constant over the range.

The gaseous fuel passes through a gas feed pipe 28 and a connection nipple 29 into a gas dosing tube 30 which is provided with corresponding lateral openings 31. A regulating rod 33, which can be moved back and forth from the outside, extends through the gas dosing tube 30 and is guided by a stuffing box 34 and is firmly connected by means of an end holder 35 and a bolting 36 to a gas control tube 37 as well as to the slide 15. Ignited gas emerging from the flame holes 21 is shown as gas flames 39.

Due to the fact that the fuel gas feed, on the one hand, and the combustion air feed, on the other hand, as well as the active burner surface, are controllable by one and the same element consisting of the slide 15, the burner tube 19 and the gas control tube 37, this control is optimal. This element 15, 19, 37 can furthermore be moved by means of a single back and forth movement of the regulating rod 33.

It thus can be expected that the source of gas delivers the gas to the gas feed pipe 28 with constant feed pressure, and the pipes are so dimensioned that a substantially constant pressure prevails within the gas dosing tube 30, so that an amount of gas proportional to the number of openings flows out through the free openings 31 debouching into the entrance chamber 23. However, the situation is different on the combustion-air side. The blower which conveys the combustion air is normally a blower with non-proportional or constant delivery characteristic, i.e. a blower of non-constant delivery quantity. With decreasing back pressure, i.e. an increasing number of air jets entering through the openings 13 into the expanding entrance chamber 23, the rate of delivery of the blower increases, the pressure in the air prechamber 9 decreasing. This circumstance must be taken into account for the specific blower in connection with the arrangement of the openings 31 in the gas dosing tube 30, so that air and gas flow into the entrance chamber 23 theoretically stepwise, because there are specific openings and not continuous slots, but actually continuously an at least constant quantity ratio of gas to combustion air being assured in the range from 10 to 100% of rated output substantially independently of the position of the regulating rod 33 and the slide 15. This non-homogeneous mixture flows out of the entrance chamber 23 and then through the static mixer 26 which it leaves as a completely homogeneous gas-air mixture and then flows out through the openings 21 which are freed corresponding to the position of the slide 15 and forms gas flames 39.

However, it is also possible to close the desired openings 13 by applying a replaceable collar on the outside of the air control plate in order in this way to obtain the optimal air/gas ratio.

The openings 13 and 31 are so arranged and their shape (round, rectangular, etc.) so selected that the requirement of the constant ratio of gas to combustion air is maintained over a wide output range.

Instead of the slide control movement there can also be provided a rotary movement of the control pistons or a mixed movement.

In the case of an increasing amount of gas or air, the number of openings per unit of stroke or their size can increase.

The same is true for the flame holes 21 and their distribution. As the load decreases, not only is the number of free openings 13 and 31 decreased, but the same is true of the number of flame holes. The size of the gas flames, however, remains practically independent of the magnitude of the load. Load variations are accommodated solely by controlling the number of flames. In other words, the number of flames is proportional to the magnitude of the load which the burner is to handle.

By selected control values, for instance the flue gas discharge temperature and the like, a regulating of the regulating rod 33 can be effected in order to set up a given program by means of the corresponding movement of said rod. The gas burner described is extremely simple in construction, reliable in operation, and easy to adapt to external conditions such as blower and the like. By replacing the gas dosing tube 30 it is possible to take into consideration different blower characteristics and to assure at least approximately in each case a constant ratio of gas to combustion air over broader output ranges which include the important range of 50 to 100% of the rated output, but which may extend down to 10%.

As experiments show, it is possible in this way to obtain a very low CO content in the flue gases of at most 0.01 vol % with an excess air coefficient of $\lambda \leqq 1.2$, and this within the range of 10 to 100% of the burner rated output. The fact that the $NO_x$ content of the flue gases cannot be measured up to a load of approximately 60% and is present only in traces between 60 and 100% shows the extremely small, indeed insignificant, environmental contamination which this burner produces.

It has furthermore been found that often the use of a suction blower on the flue gas side is to be given preference over a pressure blower for the feeding of the combustion air.

The most prominent features of this burner reside in the use of a single control element to be actuated for the controlling of the substantially constant quantity ratio of gas to air and in a variable burner surface.

I claim:

1. A gaseous fluid burner having a burner output magnitude which is variable from 0 to 100% of a predetermined rated output, the burner being usable in conjunction with a boiler, or the like, and comprising:

a mixing chamber for mixing combustion air and gas therein;

a combustion air chamber for holding combustion air therein, a first wall having air feed means defining a plurality of spaced combustion air openings, the first wall being positioned relative to the combustion air chamber and the mixing chamber to enable combustion air to flow, from the air chamber through the first wall, into the mixing chamber;

a gas chamber for holding gas therein, a second wall having gas feed means defining a plurality of spaced gas openings, the second wall being positioned relative to the gas chamber and the mixing chamber to enable the gas to pass from the gas chamber through the second wall, into the mixing chamber;

a third movable wall movable with respect to the first wall for blocking selectable numbers of the combustion air openings;

a fourth movable wall movable with respect to the second wall for blocking selectable numbers of the gas openings;

a burner tube having a distal end and having a plurality of flame openings disposed toward the distal end, the gas burner tube being connected for receiving a gas/air mixture from the mixing chamber and being effective for sustaining gas flames at the flame openings;

fifth blocking means for selectively blocking desired numbers of the flame openings of the burner tube;

the third and fourth movable walls and the burner tube being coupled to one another to form a concurrently movable unit; and moving means for moving the concurrently movable unit for selectively increasing or decreasing the number of unblocked openings in the first and second walls and the number of unblocked flame openings, wherein the air openings in the air feed means, and the gas openings in the gas feed, are configured for maintaining the quantitative ratio of the gas to the combustion air substantially constant, for all positions of the moving means which correspond to a burner output magnitude in the range of between substantially 10 to 100% of the rated output.

2. A burner according to claim 1, in which the third movable wall comprises a first hollow tube with a first external contour and the first wall is contoured to the first external contour of the first hollow tube, the fourth movable wall comprises a second hollow tube with a second external contour and the second wall is contoured to the second external contour of the second hollow tube.

3. A burner according to claim 2, in which the combustion air chamber surrounds the first hollow tube, the second hollow tube is disposed within the first hollow tube, and the mixing chamber is at least partially defined between the first and second hollow tubes.

4. A burner according to claim 3, in which the burner tube comprises a cylindrical peripheral wall extending parallel to the third and fourth movable walls.

5. A burner according to claim 3, wherein the burner tube further comprises a bottom wall which closes the distal end thereof and the gas burner openings are disposed circumferentially around the burner tube, adjacent the bottom wall.

6. A burner according to claim 3, wherein the fifth blocking means of the burner tube comprises an immersion tube which extends around the burner tube, the burner tube being movable relative to the immersion tube such that the flame openings are selectively covered by the immersion tube.

7. A burner according to claim 6, wherein the moving means are connected for rotating the third movable wall, the fourth movable wall, and also the burner tube, respectively, relative to the first wall, the second wall, and the immersion tube.

8. A burner according to claim 3, wherein the first wall is comprised of a plate having the combustion air openings defined therein.

9. A burner according to claim 3, wherein the fourth movable wall surrounds the gas chamber.

10. A burner according to claim 3, further comprising a mixer for mixing the combustion air and gas, the mixer being disposed in the mixing chamber.

11. A burner according to claim 3, wherein the burner has a portion which protrudes into a boiler and the first hollow tube protrudes into the protruding portion of the burner, the first hollow tube having an axial extension which comprises the burner tube.

12. A burner according to claim 3, further comprising a replaceable collar for fitting against the first wall, for partially blocking the combustion air openings located therein, and for determining the quantity of combustion air that may flow through the combustion air openings of the first wall.

13. A burner according to claim 3, wherein the fifth moving means for the movable unit comprises an axially movable member which is mechanically coupled to the movable unit and a regulating rod coupled to the member for moving the member and the movable unit attached thereto relative to the combustion air chamber.

14. A burner according to claim 13, wherein the rod is partially disposed in the gas chamber.

15. A gaseous fluid burner having a burner output magnitude which is variable from 0 to 100% of a predetermined rated output, the burner being usable in conjunction with a boiler, or the like, and comprising:

a mixing chamber for mixing combustion air and gas therein;

a combustion air chamber for holding combustion air therein, a first wall having air feed means defining a plurality of spaced combustion air openings, the first wall being positioned relative to the combustion air chamber and the mixing chamber, for enabling combustion air to flow, from the air chamber through the first wall, into the mixing chamber;

a gas chamber for holding gas therein, a second wall having gas feed means defining a plurality of spaced gas openings, the second wall being positioned relative to the gas chamber and the mixing chamber, for enabling the gas to pass from the gas chamber through the second wall, into the mixing chamber;

a third movable wall with respect to the first wall for blocking selectable numbers of the combustion air openings;

a fourth movable wall movable with respect to the second wall for blocking selectable numbers of the gas openings;

a burner tube having a distal end and having a plurality of flame openings disposed toward the distal end, the gas burner tube being connected for receiving a gas/air mixture from the mixing chamber and being effective for sustaining gas flames at the flame openings;

fifth blocking means for selectively blocking desired numbers of the flame openings of the burner tube; and moving means for concurrently moving the third and fourth movable walls for selectively increasing or decreasing the number of unblocked openings in the first and second walls, and further concurrently positioning the fifth blocking means and the burner tube, relative to each other, for selectively increasing or decreasing the number of unblocked flame openings, wherein the air openings in the air feed means, and the gas openings in the gas feed means, are configured for maintaining the quantitative ration of the gas to the combustion air substantially constant, for all positions of the moving means which correspond to a burner output magnitude in the range of between substantially 10 to 100% of the rated output.

16. A burner according to claim 15, wherein the third and fourth movable walls and the burner tube are coupled to one another to form a concurrently movable unit for being moved by the moving means.

17. A gaseous fluid burner having a burner output magnitude which is variable from 0 to 100% of a predetermined rated output, the burner being usable in conjunction with a boiler, or the like, and comprising:

feed means for feeding combustion air and gas;

a mixing chamber for mixing said combustion air and gas therein;

a burner tube having a plurality of flame openings connected for receiving a gas/air mixture from the mixing chamber and effective for sustaining gas flames at the flame openings; and blocking means comprising an integral blocking unit for selectively blocking desired numbers of the flame openings of the burner tube and for concurrently controllably blocking said feed means for controlling the quantities of combustion air and gas admitted into the mixing chamber such that for a burner output magnitude in the range of between substantially 10 to 100% of the rated output:

(a) the size of the gas flames remains substantially constant and the number of flame openings which remain unblocked varies in proportion to the burner output magnitude; and (b) the quantitative ratio of the gas to the combustion air remains substantially constant.

* * * * *